US005622196A

United States Patent [19]

Luongo

[11] Patent Number: 5,622,196

[45] Date of Patent: Apr. 22, 1997

[54] APPARATUS FOR WASHING OBJECTS

[76] Inventor: Arthur J. Luongo, 212 White Rock Dr., Chapin, S.C. 29036

[21] Appl. No.: 587,373

[22] Filed: Jan. 16, 1996

[51] Int. Cl.[6] ..... B08B 3/02

[52] U.S. Cl. ..... 134/72; 134/131; 134/180; 134/179

[58] Field of Search ..... 134/69, 61, 62, 134/72, 131, 172, 180, 181, 68, 179

[56] References Cited

U.S. PATENT DOCUMENTS

| | | | |
|---|---|---|---|
| 1,281,864 | 10/1918 | Sparr | 134/72 |
| 1,313,455 | 8/1919 | Blakeslef | 134/72 |
| 1,314,041 | 8/1919 | Blakeslef | 134/68 |
| 1,404,570 | 1/1922 | Blakeslef | 134/72 |
| 1,404,706 | 1/1922 | Blakeslef | 134/72 |
| 1,431,870 | 10/1922 | Blakeslef | 134/72 |
| 1,583,034 | 5/1926 | Valerius et al. | 134/68 |
| 1,664,637 | 4/1928 | Merseles et al. | 134/72 X |
| 2,633,437 | 3/1953 | Detjen | 134/72 |
| 2,682,881 | 7/1954 | Bocchino | 134/129 |
| 2,698,627 | 1/1955 | Kearney et al. | 134/72 X |
| 2,766,764 | 10/1956 | Bennett | 134/72 |
| 2,838,025 | 6/1958 | Miller, Jr. et al. | 134/72 |
| 2,926,674 | 3/1960 | Umbricht et al. | 134/72 |
| 2,981,266 | 4/1961 | Tamburri | 134/72 |
| 2,997,048 | 8/1961 | Gertken et al. | 134/72 |
| 3,054,411 | 9/1962 | Randall | 134/144 X |
| 3,179,117 | 4/1965 | Gibson et al. | 134/131 X |
| 3,411,518 | 11/1968 | Fisher et al. | 134/72 |
| 4,281,675 | 8/1981 | Pure | 134/125 |
| 4,285,352 | 8/1981 | McMahon et al. | 134/48 |
| 4,287,901 | 9/1981 | Fowler | 134/56 R |
| 4,732,172 | 3/1988 | Pedersen | 134/62 |
| 4,807,319 | 2/1989 | Poitevin | 15/21 D |
| 4,971,084 | 11/1990 | Smith et al. | 134/181 |
| 5,062,438 | 11/1991 | Micheletti | 134/9 |
| 5,133,375 | 7/1992 | Schinzing et al. | 134/123 |
| 5,231,726 | 8/1993 | McKenney et al. | 15/88.3 |
| 5,419,349 | 5/1995 | Swain | 134/72 |

*Primary Examiner*—Frankie L. Stinson
*Attorney, Agent, or Firm*—Michael A. Mann, P.A.

[57] ABSTRACT

Apparatus for washing objects. The apparatus comprises a frame supporting a housing dimensioned to receive various, irregularly shaped objects. A conveyor belt having exterior sections that extend beyond the housing entrance and exit, conveys objects through the housing as a first series of nozzles spray the objects with a cleaning solution, Then, the objects are washed by a pair of high speed rotating sprayer arms, mounted on the exterior sides of the housing, which direct pressurized water through circular cut out portions formed in the sides of the housing to the objects being conveyed through the housing. The objects are then rinsed by a second series of nozzles and subsequently exit the housing. The exterior sections of the conveyor belt are rotatable and are rotated toward the housing to form a compact configuration for transportation and storage.

15 Claims, 2 Drawing Sheets

APPARATUS FOR WASHING OBJECTS

BACKGROUND OF THE INVENTION

1. Field of the Invention

The present invention relates generally to an apparatus for washing objects. More specifically, the present invention relates to an apparatus for washing various irregularly shaped objects.

2. Discussion of Background

There exists in the art several methods and apparatus for washing different objects. What follows is an overview of the art's current state.

U.S. Pat. No. 2,997,048 teaches an apparatus for washing shopping carts. The carts are placed in guide rails located at the entrance to a housing. A pulley pulls the cart through the interior of the housing. Disposed about the interior of the housing is a series of pipes that expel water, steam, and detergent onto the carts as they move through the housing.

U.S. Pat. No. 4,281,675 sets forth an apparatus designed to wash insulated trays. The apparatus comprises a housing having an endless conveyor placed along the floor of the housing. The conveyor has guide rails extending therefrom which hold the trays at a 5° to 10° position off vertical. A pump in fluid communication with a pair of manifolds located on the interior sides of the housing supply water to wash the trays. The water is accelerated from the manifold by a series of nozzles formed therein.

U.S. Pat. No. 2,981,266 teaches a mobile car washing apparatus having a housing equipped with wheels enabling its transportation. The housing contains an entrance and an exit ramp. Located about the interior of the housing is an inverted U-shaped pipe that supplies water to the vehicle.

U.S. Pat. No. 5,113,375 discloses a wheelchair washer. The wheelchair is placed into a housing through a door formed at one end. A plurality of sprayer arms, positioned about the sides or top of the interior of the housing, supply water to clean the chair.

U.S. Pat. No. 2,633,437 discloses a method and apparatus for cleaning kitchen utensils. The apparatus comprises an endless conveyor which introduces the utensils into the interior of a housing. Positioned within the interior of the housing are a series of rectangularly shaped pipes fitted with a plurality of apertures which spray water, detergent and degreaser onto the utensils.

Although it is readily apparent that there exists a variety of different washing apparatus designed to wash specific items, e.g., trays, cars, kitchen utensils, and wheelchairs, there is lacking in the art a mobile, washing apparatus capable of accepting and effectively washing a variety of irregularly shaped items.

Moreover, a major, and heretofore unaddressed, problem encountered by the prior art is damage to both the water supply mechanism and to the objects being conveyed therethrough. The majority of the present designs feature either a series of sprayer arms, or pipes equipped with apertures, which supply water to the objects to be washed. These water supply mechanisms are located in the interior of the housing. As a result, either these mechanisms or the piping may be damaged by objects or may inflict damage on objects that are free to move laterally while being conveyed longitudinally through a housing as the water is directed onto them. Most of these apparatus provide rails or guides that maintain the lateral position of the moving objects and work well, by and large, when the objects being washed are uniform and of one type.

Therefore, there exists a need for a portable washing apparatus that minimizes damage to the water supplying mechanisms and is capable of cleansing a variety of differently shaped and sized objects.

SUMMARY OF THE INVENTION

According to its major aspects and broadly stated, the present invention is a mobile apparatus for washing objects. The apparatus comprises a frame which carries a housing dimensioned for the objects to be washed and preferably dimensioned for a variety of differently shaped and sized objects. The entrance is on one end of the housing and the exit is on the other. Curtains are provided at the entrance and exit to the housing to confine water within the housing. An endless conveyor belt, which extends beyond both the entrance and the exit to the housing, conveys objects into, through, and out of the housing. Just inside the entrance to the housing, a first series of nozzles, arranged vertically within the interior of the housing, sprays the objects with a cleaning solution. The objects are then washed by a pair of rotating sprayers positioned on opposing sides of the exterior of the housing. Water is directed by the spraying arms at a high pressure, preferably no less than 3000 psi. Each sprayer arm has a pair of diverging, angled nozzles which, when subjected to a high water pressure, cause high speed rotation of the sprayer arm, in particular, at least 3000 rpm. The water jets from these nozzles enter the interior of the housing through circular cut out portions formed in the sides of the housing. After being washed, the objects pass through a curtain that separates the washing section from the rinse section and are then rinsed of cleaning solution by a second series of vertically arranged nozzles, and subsequently conveyed through the housing exit.

Positioned below the conveyor belt is a pull out drawer, solution tank and rinse water tank. The drawer holds a gas motor and pump that provide the necessary water pressure to the rotating sprayer arms. Located below the external sections of the conveyor belt are drip pans that are angled to carry water and cleaning solution back to their respective tanks. When not in use, the sections of the endless conveyor extend beyond the housing entrance and exit, and the drip pans pivot to a more compact position.

A major feature of the present invention is the positioning of the rotating sprayer arms on the exterior of the housing rather than in the interior. This positioning removes the sprayer arms from the path of the objects being conveyed through the housing and eliminates interference between them. Consequently, the potential for damage from objects colliding with sprayers is eliminated. Furthermore, no rails or guides are needed to maintain the laterial positioning of the objects within the housing. Moreover, more of the interior space is available for larger objects.

Directing water at a high pressure through the angled nozzles of the sprayer arms is another feature of the present invention. Introduction of high water pressure through nozzles that are offset with respect to each other causes rapid rotation of the sprayer arms. This rapid rotation, along with the highly pressurized water, efficiently and effectively dislodges dirt and grime from all surfaces of the object as it moves through the housing.

Still another feature of the present invention is the rotation of the exterior sections of the conveyor belt. When storing or transporting the apparatus, the exterior sections of the belt are pivoted toward the housing from a horizontal position to a substantially vertical position. In this more compact configuration, the space requirements for transporting and storing the apparatus are reduced.

Yet another feature of the present invention is the ability to wash objects which are different in both size and shape. The dimensions of the housing enable it to receive and effectively wash an assortment of different objects ranging from outdoor patio or pool furniture to large engine parts such transmission blocks. As a consequence, the present invention has a wider range of industrial applications.

A number of features contribute to the portability of the apparatus, making it ideal for one-time applications at different locations, also an important aspect of the invention. These features include the use of a gasoline engine, castors, an efficient water management system that can be supplied with water from a garden hose, and compact size.

These and other important features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

The present invention is a portable apparatus for washing a variety of objects. The present invention is particularly suited for washing objects that are bulky and of irregular shape. The objects capable of being cleaned by the present invention include, but are not limited to, pool and patio furniture, automotive engine parts, and industrial machine parts.

Figure 1:
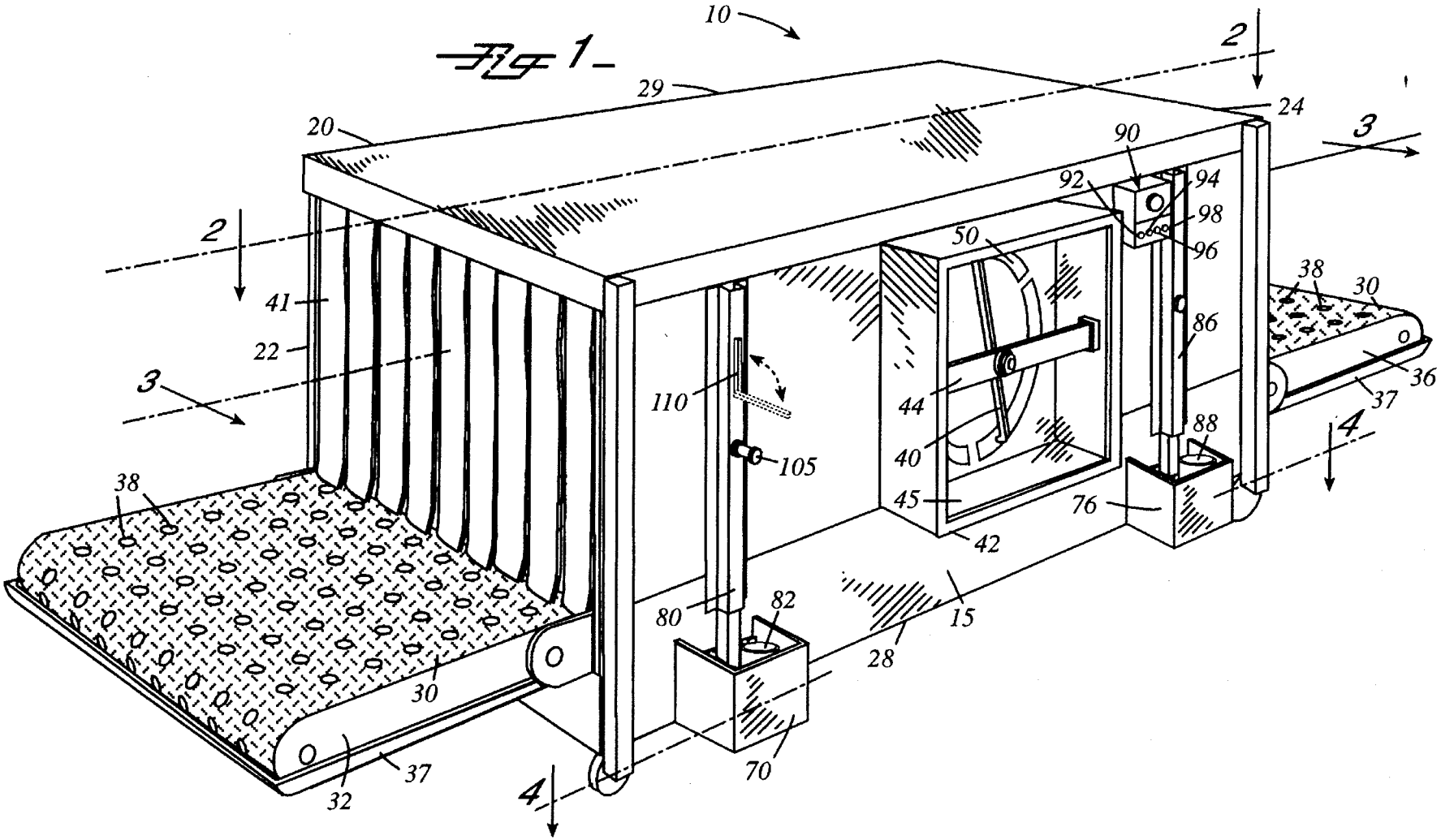
FIG. 1 is a perspective view of an apparatus for washing objects according to a preferred embodiment of the present invention.
Figure 2:
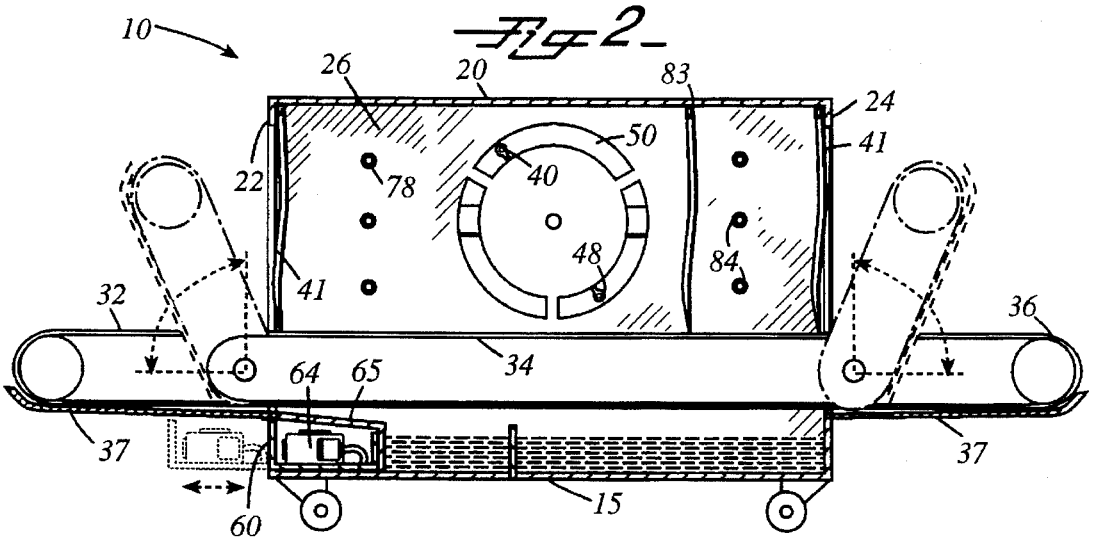
FIG. 2 is a cross sectional side view of an apparatus for washing objects according to a preferred embodiment of the present invention, taken along line 2—2 of FIG. 1.
Figure 3:
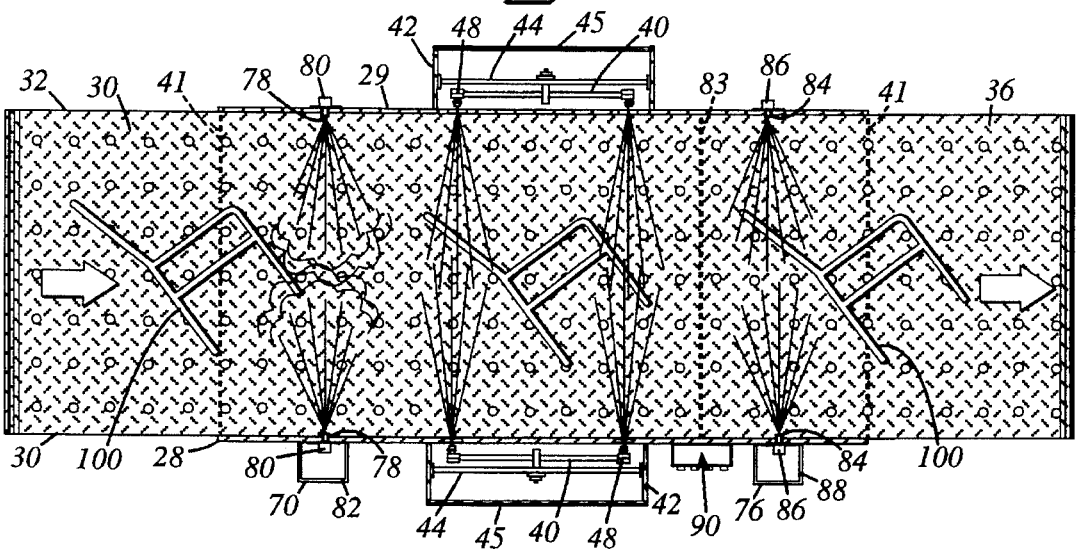
FIG. 3 is a cross sectional top view of an apparatus for washing objects according to a preferred embodiment of the present invention, taken along line 3—3 of FIG. 1.
Figure 4:
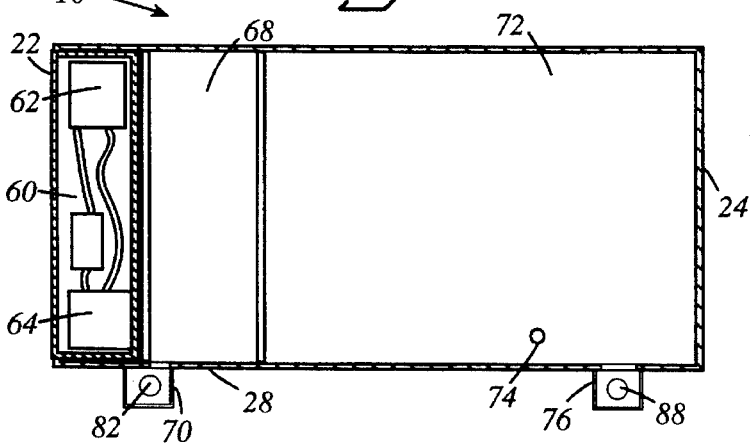
FIG. 4 is a cross sectional top view of an apparatus for washing objects according to a preferred embodiment of the present invention, taken along line 4—4 of FIG. 1.

Referring now to the Figures, the apparatus, generally indicated by reference numeral 10, has frame 15 carrying a housing 20 having an entrance 22, and an exit 24, a conveyor belt 30 that transports objects, illustrated generally in FIG. 3 as chairs 100, from entrance 22 to exit 24, and, finally, rotating sprayer arms 40. Conveyor belt 30 has an entrance section 32, extending beyond entrance 22, an interior section 34 that runs through interior 26 of housing 20, and an exit section 36, that extends beyond exit 24. A sloped drip pan 37 is under both entrance section 32 and exit section 36. Drip pan 37 collects fluid from conveyor belt 30 and returns it to interior 26 of housing 20. Formed on the surface of conveyor belt 30 are a plurality of holes 38. Holes 38 allow fluid to pass through conveyor belt 30 and enter their respective tanks, as will be discussed in detail below. To prevent water and cleaning fluid from exiting interior 26 of housing 20, curtains 41 are provided at entrance 22 and exit 24 of housing 20. Curtains 41 may be made of any waterproof, polymeric material having the requisite weight needed to prevent fluids from leaving interior 26.

Positioned below conveyor belt 30 and within frame 15, at entrance 22, is a pull-out drawer 60. Drawer 60 holds a gas motor 62 and a pump 64 which are used to supply pressurized water to sprayer arms 40. To maintain or replace motor 62 or pump 64, drawer 60 is pulled away from frame 15 for access to them. Positioned above drawer 60 is a sloped lid 65. Lid 65 transports water collected by drip pan 37 into a solution tank 68, which is adjacent to drawer 60. Solution tank 68 is dimensioned to hold an amount of cleansing fluid sufficient to clean a predetermined number of objects 100. Optionally, solution tank 68 may hold a heating means (not shown) in order to heat the solution contained therein. In fluid communication with solution tank 68 is a first sump 70, positioned on the exterior of side 28 of frame 15. Abutting solution tank 68 is a rinse tank 72. Rinse tank 72 is dimensioned to hold a sufficient quantity of water required for a particular task. A drain 74 is positioned in rinse tank 72, allowing drainage of the contents of rinse tank 72. In fluid communication with rinse tank 72 is a second sump 76.

Proximate to entrance 22 and in fluid communication with interior 26, is a first series of nozzles 78. Nozzles 78 are arranged vertically on side 28 and 29 of housing 20 and protected by brackets 80. Nozzles 78 spray cleaning solution received from solution tank 68 via electric pump 82 positioned within sump 70 onto objects 100 entering interior 26.

Rotating sprayer arms 40 are encased in enclosures 42 that extend from sides 28 and 29 of housing 20. The interior of enclosures 42 is fitted with horizontal members 44, upon which sprayer arms 40 are rotatably mounted and maintained, so that sprayer arm 40 is held a fixed distance from the exterior of sides 28 and 29. Preferably, enclosures 42 also contain a transparent front face cover 45, which allows an individual to observe the operation of rotating sprayer arms 40.

At the ends of sprayer arms 40 are nozzles 48. Nozzles 48 are angled, and with respect to one another, are offset. Consequently, when water from rinse tank 72 is forwarded at high pressure, preferably as much as 3000 psi, by pump 64 to sprayer arms 40, expulsion of the water from nozzles 48 will cause the rapid rotation, on the order of 3000 rpm, of sprayer arms 40. The water expelled from sprayer arms 40 enters interior 26 of housing 20 through circular cut out portions 50 formed in sides 28 and 29. It is appreciated that the water expelled from rotating sprayer arms 40 defines a path, and that circular cut out portions 50 are dimensioned and located in sides 28 and 29, so that they are aligned with or coincide with that path, in order for the water to pass through the cutout portions 50 from the exterior of apparatus 10 to its interior. It is also appreciated that it is within the spirit and scope of the present invention to substitute rotating sprayer arms 40 for other moving washing means, for example oscillating nozzles. It follows in such an example that cut out portions would be formed in sides 28 and 29 to include a substantial part of the path defined by the water sprayed from such oscillating nozzles.

Sprayer arms 40 rotate in the same direction, either clockwise or counterclockwise, from the perspective of someone facing front face cover 45 of enclosures 42. Consequently, objects 100 being conveyed through interior 26 of housing 20 experience counter rotation of water from sprayer arms 40. The combination of rapid rotation of sprayer arms 40, the high pressure of water being expelled from nozzles 48, and the counter rotation experienced by objects 100, effectively washes dirt and grime from all surfaces of objects 100. In addition, since sprayer arms 40 are located exterior to housing 20, the possibility of objects 100 colliding with sprayer arms 40 is eliminated.

Proximate to exit 24 and in fluid communication with interior 26, is a second series of nozzles 84. A curtain 83 is provided within interior 26 and is positioned between nozzles 84 and circular cut out portions 50. Nozzles 84 are arranged vertically on sides 28 and 29 of housing 20 and protected by brackets 86. Nozzles 84 receive water from rinse tank 72 via electric pump 88 positioned within sump 76, and spray water into interior 26 to rinse objects 100 before they exit housing 20.

To operate apparatus 10, a cleaning solution is poured into sump 70, thereby filling solution tank 68. The cleaning solution chosen will depend upon the type of objects 100 that are to be washed. For instance, if objects 100 are pool or patio chairs, the cleaning solution may include a mildew remover, a mild detergent and water. If objects 100 are industrial or automotive parts, then the cleaning solution may include an industrial strength degreaser. Thereafter, a quantity of water is poured into sump 76 to rinse tank 72.

To activate apparatus 10, a control panel 90 is provided on the exterior of side 28 of housing 20. Control panel 90 preferably has four switches. A first switch 92 activates and deactivates electric pumps 82 and 88. A second switch 94 controls the operation of conveyor belt 30. Third switch 96 activates gas motor 62. A fourth switch 98 controls a solenoid valve. Actuation of the solenoid valve permits pressurized water from pump 64 to reach sprayer arms 40. It is preferable to begin the operation of apparatus 10 by first turning on switches 92, 94 and 96. Thereafter, fourth switch 98 may be activated to forward pressurized water to sprayer arms 40.

When apparatus 10 is in operation, objects 100 are conveyed into housing 20 and sprayed with a cleaning solution by nozzles 78. Thereafter, objects 100 are washed with pressurized water from rotating spraying arms 40. The combination of high pressure of the water expelled and the rotation of sprayer arms 40 ensures that all dirt and grime will be removed from the surfaces of objects 100. Thereafter, objects 100 pass through curtain 83, are rinsed by nozzles 84 and subsequently exit interior 26 of housing 20.

Recycling of fluids during the operation of apparatus 10 is achieved as follows: fluid contained on entrance section 32 of conveyor belt 30 will pass through holes 38 and onto drip pan 37. The fluid will then migrate towards housing 20, over lid 65, and be deposited into solution tank 68. Fluid expelled by nozzles 78 will pass through holes 38 and into solution tank 68 as water sprayed from rotating arms 40 and nozzles 84 is received by rinse tank 72. Also, water remaining on exit section 36 of conveyor 30 will run from drip pan 37 to rinse tank 72.

After objects 100 have been washed, water is released from rinse tank 72 by opening drain 74. To allow for the proper disposal of cleaning fluid, solution tank is evacuated using the following procedure. A hose is attached to a fitting 105 located on bracket 80 on side 28. A lever 110, also located on bracket 80, is then rotated to the horizontal position. The horizontal rotation of lever 110 prevents cleaning solution from entering nozzles 78 and diverts such solution into fitting 105. Thereafter, pump 82 is actuated to pump cleaning solution from solution tank 68 through a hose attached to fitting 105 and into a proper receptacle.

When it is desired to store or transport apparatus 10, entrance section 32 and exit section 36 are pivoted along with drip pans 37, toward housing 20, from a horizontal, or operating, position to a vertical, or storage, position. The pivoting of entrance and exit sections 32 and 36 allows a more compact configuration that enables apparatus 10 to be easily transported and also reduces the space requirements needed for storage.

It will be apparent to those skilled in the art that many modifications and substitutions can be made to the preferred embodiment just described without departing from the spirit and scope of the invention as defined in the appended claims.

What is claimed is:

1. Apparatus for washing objects with a fluid, said apparatus comprising:

a frame;

a housing carried by said frame, said housing having an entrance and an opposing exit, opposing sides, an interior and an exterior, and a cutout portion;

means carried by said frame for conveying said objects through said interior of said housing from said entrance to said exit past said cutout portion; and at least one sprayer arm carried a fixed distance from said exterior of said housing, said sprayer arm having a first end and an opposing second end, said first end having a first nozzle attached thereto, said first nozzle attached to said first end at a first angle, said second end having a second nozzle attached thereto, said second nozzle attached to said second end at a second angle, said first angle being offset with respect to said second angle so that said sprayer arm moves as its sprays said fluid, said sprayer arm washing said objects by spraying said fluid through said cutout portion in said housing as said objects are conveyed by said conveying means past said cutout portion.

2. The apparatus as recited in claim 1, wherein said at least one sprayer arm oscillates as it sprays said fluid, whereby said fluid defines a path, and said cutout portion is dimensioned and located on said housing to coincide with a substantial part of said path so that said fluid can pass from said exterior to said interior of said housing.

3. The apparatus as recited in claim 1, wherein said at least one sprayer arm rotates as it sprays said fluid, whereby said fluid defines a circular path, and said cutout portion is dimensioned and located on said housing to coincide with a substantial part of said path so that said fluid can pass from said exterior to said interior of said housing.

4. The apparatus as recited in claim 1, wherein said at least one sprayer arm expels fluid into said interior of said housing at a pressure up to approximately 3000 psi.

5. The apparatus as recited in claim 1, wherein said housing further comprises a first series of vertical nozzles and a second series of vertical nozzles, said first series of nozzles positioned in said sides of said housing proximate to said entrance, said first series of nozzles spraying a cleaning solution into said interior of said housing, said second series of nozzles positioned in said sides of said housing proximate to said exit, said second series of nozzles spraying water into said interior of said housing.

6. Apparatus for washing objects, said apparatus comprising:

a frame;

a housing carried by said frame, said housing having an entrance and an opposing exit, opposing sides, an interior and an exterior;

means carried by said frame for conveying said objects through said interior of said housing from said entrance to said exit, said conveying means having an operating position and a storage position, said conveying means being extended from said housing when in said operating position and pulled closer to said housing when in said storage position; and at least one sprayer arm carried by said housing, said sprayer arm having a first end and an opposing second end, said first end having a first nozzle attached thereto, said first nozzle attached to said first end at a first angle said second end having a second nozzle attached thereto, said second nozzle attached to said second end at a second angle, said first angle being offset with respect to said second angle so that said sprayer arm moves as its sprays, sprayer arm washing said objects as said objects are conveyed by said conveying means through said housing.

7. The apparatus as recited in claim 6, wherein said conveying means further comprises a rotatable entrance section extending beyond said entrance to said housing and a rotatable exit section extending beyond said exit to said housing, said entrance section and said exit section being substantially horizontal when in said operating position, said entrance section and said exit section being substantially vertical when in said storage position.

8. The apparatus as recited in claim 6, wherein said at least one sprayer arm is carried by said exterior of said housing, said at least one sprayer arm spraying fluid into said interior of said housing through a cutout portion formed in said housing.

9. The apparatus as recited in claim 6, wherein said at least one sprayer arm is carried by said exterior of said housing, said at least one sprayer arm spraying fluid into said interior of said housing through a cutout portion formed in said housing, wherein said at least one sprayer arm oscillates as it sprays said fluid, whereby said fluid defines a path, and said cutout portion is dimensioned and located on said housing to coincide with a substantial part of said path so that said fluid can pass from said exterior to said interior of said housing.

10. The apparatus as recited in claim 6, wherein said at least one sprayer arm is carried by said exterior of said housing, said at least one sprayer arm spraying fluid into said interior of said housing through a cutout portion formed in said housing, wherein said at least one sprayer arm rotates as it sprays, whereby said fluid defines a circular path, and said cutout portion is dimensioned and located on said housing to include a substantial part of said path, so that said fluid can pass from said exterior to said interior of said housing.

11. The apparatus as recited in claim 6, wherein said at least one sprayer arm is carried by said exterior of said housing, said at least one sprayer arm spraying fluid into said interior of said housing through a cutout portion formed in said housing.

12. The apparatus as recited in claim 6, wherein said at least one sprayer arm expels fluid at a pressure up to approximately 3000 psi.

13. The apparatus as recited in claim 6, wherein said housing further comprises a first series of vertical nozzles and a second series of vertical nozzles, said first series of nozzles positioned in said sides of said housing proximate to said entrance, said first series of nozzles spraying a cleaning solution into said interior of said housing, said second series of nozzles positioned in said sides of said housing proximate to said exit, said second series of nozzles spraying water into said interior of said housing.

14. Apparatus for washing objects, said apparatus comprising:

a frame;

a housing carried by said frame, said housing having an entrance and an opposing exit, opposing sides, an interior and an exterior, and a circular cutout portion;

means carried by said frame for conveying said objects through said interior of said housing from said entrance to said exit, said conveying means having a rotatable entrance section extending beyond said entrance to said housing and a rotatable exit section extending beyond said exit to said housing, said entrance section and said exit section being substantially horizontal when in said operating position, said entrance section and said exit section being substantially vertical when in said storage position; and at least one rotating sprayer carried a fixed distance from said exterior of said housing, said sprayer arm having a first end and an opposing second end, said first end having a first nozzle attached thereto, said first nozzle attached to said first end at a first angle, said second end having a second nozzle attached thereto, said second nozzle attached to said second end at a second angle, said first angle being offset with respect to said second angle so that said sprayer arm rotates as it sprays said fluid, said sprayer arm washing said objects by spraying fluid through said circular cutout portion in said housing as said objects are conveyed by said conveying means past said cutout portion, said at least one rotating sprayer arm expelling fluid into said interior of said housing at a pressure up to approximately 3000 psi.

15. The apparatus as recited in claim 14, wherein said at least one rotating sprayer arm is at least two rotating sprayer arms.

* * * * *